US006287001B1

(12) United States Patent
Buchman

(10) Patent No.: US 6,287,001 B1
(45) Date of Patent: Sep. 11, 2001

(54) CLOSURE ARRANGEMENT HAVING INTERLOCKING CLOSURE PROFILES, SLIDER DEVICE, AND SYSTEMS AND METHODS FOR RETAINING SLIDER DEVICE

(75) Inventor: James E. Buchman, Hortonville, WI (US)

(73) Assignee: Reynolds Consumer Products, Inc., Richmand, VA (US)

( * ) Notice: Subject to any disclaimer, the term of this patent is extended or adjusted under 35 U.S.C. 154(b) by 0 days.

(21) Appl. No.: 09/561,290

(22) Filed: Apr. 28, 2000

Related U.S. Application Data

(60) Provisional application No. 60/133,011, filed on May 7, 1999.

(51) Int. Cl.[7] ..... B65D 33/16
(52) U.S. Cl. ..... 383/64; 24/400
(58) Field of Search ..... 383/64; 24/399, 24/400

(56) References Cited

U.S. PATENT DOCUMENTS

| | | | | |
|---|---|---|---|---|
| 3,790,992 | | 2/1974 | Herz . | |
| 4,890,935 | | 1/1990 | Ausnit et al. . | |
| 5,067,208 | * | 11/1991 | Herrington, Jr. et al. | 24/400 |
| 5,088,971 | | 2/1992 | Herrington . | |
| 5,131,121 | | 7/1992 | Herrington, Jr. et al. . | |
| 5,161,286 | | 11/1992 | Herrington, Jr. et al. . | |
| 5,301,395 | | 4/1994 | Richardson et al. . | |
| 5,405,478 | | 4/1995 | Richardson et al. . | |
| 5,448,807 | | 9/1995 | Herrington, Jr. . | |
| 5,482,375 | | 1/1996 | Richardson et al. . | |
| 5,664,299 | * | 9/1997 | Porchia et al. | 24/400 |
| 5,669,715 | | 9/1997 | Dobreski et al. . | |
| 5,713,669 | | 2/1998 | Thomas et al. . | |
| 5,836,056 | * | 11/1998 | Porchia et al. | 24/400 |
| 5,924,173 | * | 7/1999 | Dobreski et al. | 24/400 |
| 5,950,285 | * | 9/1999 | Porchia et al. | 24/400 |
| 6,088,887 | * | 7/2000 | Bois | 24/399 |

* cited by examiner

*Primary Examiner*—Jes F. Pascua

(57) ABSTRACT

A flexible package includes a package surrounding wall having a side edge and a mouth. A recloseable zipper is provided along the mouth for selective opening and closing of the mouth. The zipper includes first and second closure profiles. The first closure profile has a first closure member and a first flange. The second closure profile has a second closure member and a second flange. The first and second closure members are constructed and arranged to selectively interlock. A slider device is constructed and arranged to selectively open and close the mouth. A first seal region and a second seal region are provided. The first seal region permanently secures together the first and second flanges of the first and second closure profiles. The first seal region has a first length extending from the side edge. The second seal region permanently secures together the first and second closure members of the first and second closure profiles. The second seal region has an end edge extending a second length from the side edge. The second length is greater than the first length, and is at least 25% of the length of the slider device. In one embodiment, the second seal region is a continuous, uninterrupted extension from the side edge to the end edge. In another embodiment, the second seal region comprises first and second seal sections separated by a gap.

21 Claims, 9 Drawing Sheets

20

CLOSURE ARRANGEMENT HAVING INTERLOCKING CLOSURE PROFILES, SLIDER DEVICE, AND SYSTEMS AND METHODS FOR RETAINING SLIDER DEVICE

CLAIM TO PRIORITY UNDER 35 U.S.C. §119(e)

Priority under 35 U.S.C. §119(e) is claimed to provisional application Ser. No. 60/133,011, filed on May 7, 1999, and entitled, Closure Arrangement Having Interlocking Closure Profiles, Slider Device, And Systems And Methods For Retaining Slider Device." The complete disclosure of application Ser. No. 60/133,011 is incorporated by reference herein.

FIELD

The present invention generally relates to closure arrangements for packages. In particular, the present invention relates to closure arrangements having reclosable profiles and slider devices to open and close the profiles.

BACKGROUND

Many packaging applications use resealable containers to store various types of articles and materials. These packages may be used to store and ship food products, non-food consumer goods, medical supplies, waste materials, and many other articles.

Resealable packages are convenient in that they can be closed and resealed after the initial opening to preserve the enclosed contents. The need to locate a storage container for the unused portion of the products in the package is thus avoided. As such, providing products in resealable packages appreciably enhances the marketability of those products.

Slider devices have been used to help open and close closure profiles on reclosable bags. In some instances, the slider devices can be ejected from the reclosable bag when the bag is open and the sides of the bag are pulled outwardly. Improvements in closure arrangements are desirable.

SUMMARY OF THE DISCLOSURE

In one aspect, the disclosure describes a flexible package including a package surrounding wall having a side edge and a mouth. A recloseable zipper is provided along the mouth for selective opening and closing of the mouth. The zipper includes first and second closure profiles. A slider device is provided to selectively open and close the mouth. A first seal region and a second seal region are provided on the flexible package. The first seal region permanently secures together first and second flanges of first and second closure profiles. The second seal region permanently secures together the first and second closure members of the first and second closure profiles and has an end edge. The length of the second seal region is at least 25% of the length of the slider device.

In one embodiment, the second seal region is a continuous, uninterrupted extension from the side edge to the end edge.

In another embodiment, the second seal region comprises first and second seal sections separated by a gap.

Methods of sealing and operation are provided.

The above summary is not intended to describe each illustrated embodiment or every implementation of the present invention. The figures and the detailed description that follow more particularly exemplify these embodiments.

BRIEF DESCRIPTION OF THE DRAWINGS

The invention may be more completely understood in consideration of the detailed description of various embodiments of the invention that follows in connection with the accompanying drawings in which.

Figure 1:
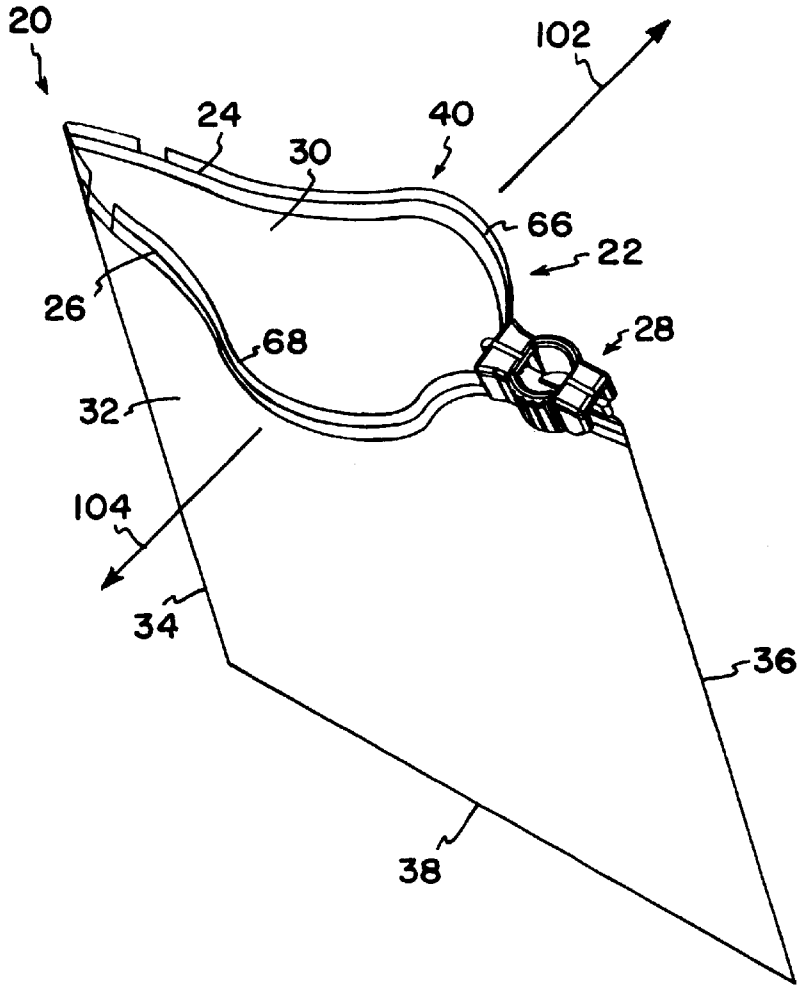
FIG. 1 is a perspective view of one embodiment of a flexible, reclosable package.

While the invention is amenable to various modifications and alternative forms, specifics thereof have been shown by way of example in the drawings and will be described in detail.

DETAILED DESCRIPTION

Attention is directed to FIG. 1. FIG. 1 illustrates an example packaging arrangement in the form of a resealable, flexible package 20 having a zipper 22 with first and second closure profiles 24, 26 and a slider device 28 to open and close the profiles 24, 26.

The flexible package 20 includes first and second opposed panel sections 30, 32 made from a flexible, polymeric film. For some manufacturing applications, the first and second panel sections 30, 32 are heat-sealed together along two edges 34, 36 and meet at a fold line in order to form a three-edged containment section for a product within the interior of the package 20. The fold line comprises the bottom edge 38. Alternatively, two separate panel sections 30, 32 of polymeric film may be used and heat-sealed together along the two edges 34, 36 and at the bottom 38. Access is provided to the interior of the package 20 through a mouth 40. In other implementations, the package 20 includes tear strings and/or notches at the mouth 40 to assist with opening the package 20.

The zipper 22 can include a variety of configurations and structures. For example, the zipper 22 can be constructed according to U.S. Pat. Nos. 4,240,241; 4,246,288; or 4,437,293; each of which is incorporated by reference herein.

The slider device 28 can include a variety of configurations and structures. One particular example of a slider device 28 useable is illustrated in more detail in FIGS. 10–13. The slider device 28 includes a top wall 50 and a pair of side walls 52, 54 extending from the wall 50 such that the walls 52, 54 form a generally C-shaped channel. The slider device 28 also includes a spreader or plow 56 extending or projecting from the wall 50. In the embodiment illustrated, the plow 56 comprises first and second angled wedges 58, 60 separated by a gap 62.

In preferred embodiments, the plow 56 only extends between upper flanges 66, 68 of the closure profiles 24, 26 and does not penetrate the particular closure members of the closure profiles 24, 26. This helps to ensure a leak-proof closure mechanism.

Figure 12:
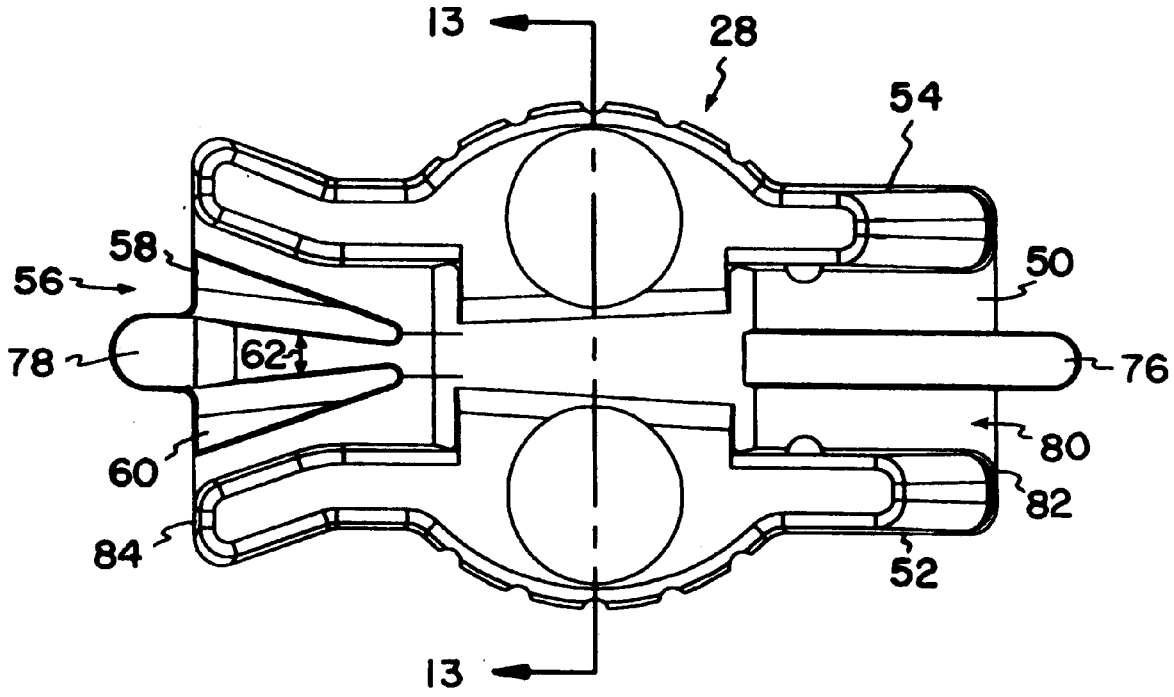
FIG. 12 is bottom plan view of the slider device depicted in FIG. 10.
Figure 13:
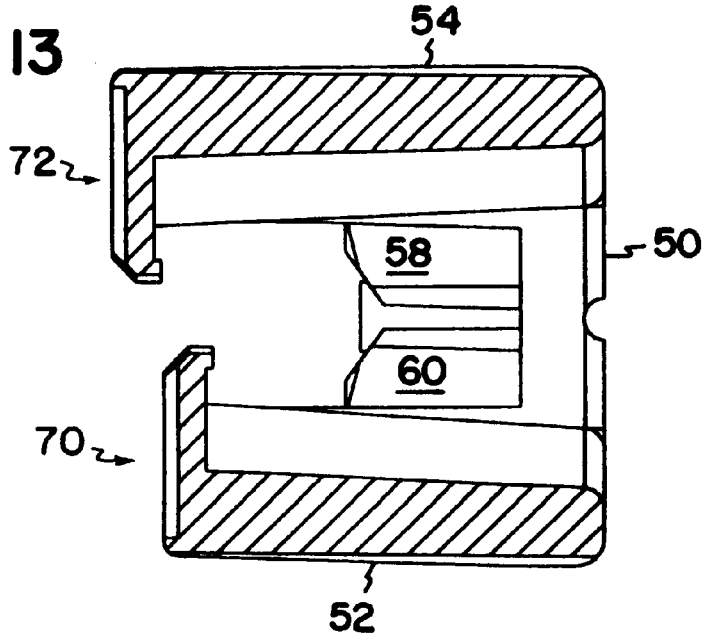
FIG. 13 is a cross-sectional view of the slider device of FIGS. 10–12 and taken along the line 13—13 of FIG. 12.

FIG. 13 illustrates a cross-section taken along the line 13—13 of FIG. 12. In FIG. 13, the side walls 52, 54 are shown in cross section. First and second hook constructions 70, 72 are viewable in FIG. 13. First and second hook constructions 70, 72 help to permit the slider device 28 to slide along the zipper 22 without becoming disengaged from the package 20.

The slider device 28 also includes a pair of bumpers or projecting fingers 76, 78. The first and second fingers 76, 78 are illustrated as projecting from the top wall 50. The first and second fingers 76, 78 act to engage the side edges 34, 36 of the package 20.

To operate, the slider device 28 is slid relative to the zipper 22 from a position where the first and second closure profiles 24, 26 are interlocked to a position where the first and second closure profiles 24, 26 are disengaged. As the slider device 28 is moved from a position where the first and second closure profiles 24, 26 are locked, the plow 56 forces the closure members of the first and second closure profiles 24, 26 apart from each other. This opens the mouth 40 as the slider device 28 is moved along the zipper 22 in the direction where the triangle of the plow 56 "points". To close the mouth 40, the slider device 28 is moved in the opposite direction. The closing happens because the slide channel 80 between the side walls 52, 54 is narrower at the end 82 (the end opposite of the plow 56) and is wider at the end 84 (the end near the plow 56).

Figure 4:
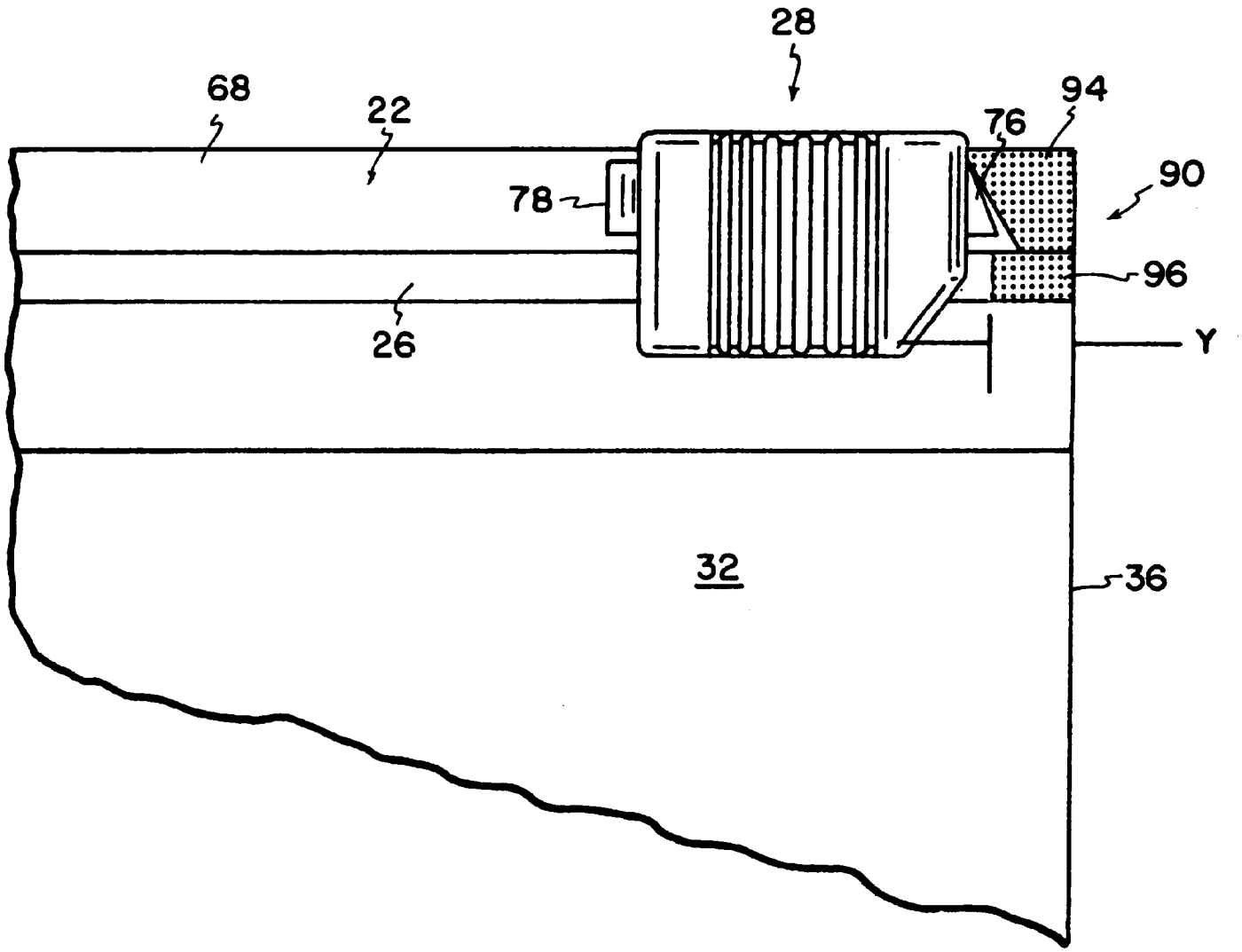
FIG. 4 is an enlarged, side elevational view of a portion of the flexible, reclosable package depicted in FIG. 3 and showing the slider device adjacent to the side edge.

Attention is again directed to FIG. 4. In FIG. 4, it can be seen that there is a region of ultrasonic crushing forming a seal region along the edge 36. The seal region 90 includes a first seal region 94 and a second seal region 96. The first seal region 94 secures or seals together the upper flanges 66, 68 of the first and second closure profiles 24, 26. Note that the first seal region 94 is generally trapezoidal in shape, and the finger 76 abuts and engages the first seal region 94. The second seal region 96 is adjacent to and, in the view shown in FIG. 4, below the first seal region 94. That is, the second seal region 96 is located between the first seal region 94 and the bottom edge 38 of the package 20. The second seal region 96 acts to secure or seal together the closure members of the first and second closure profiles 24, 26. The second seal region 96 generally extends a distance Y from the edge 36. Typically, this distance Y will be about 0.25 in. (about 0.6 cm).

Figure 3:
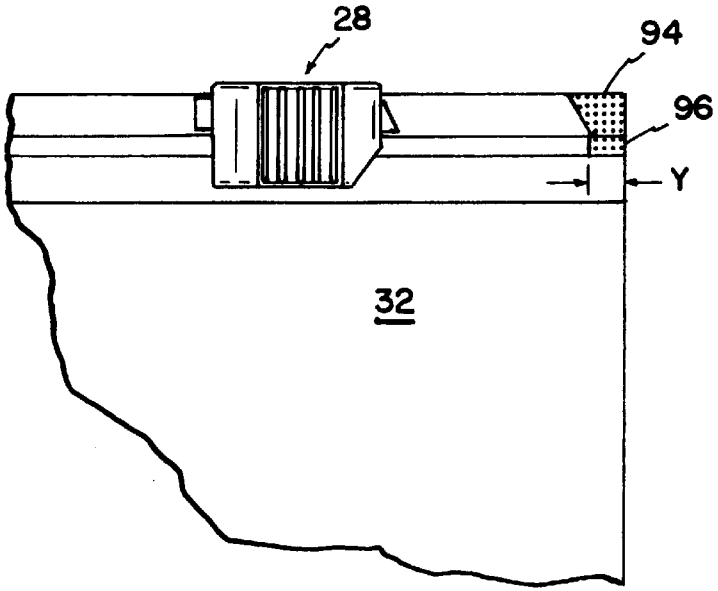
FIG. 3 is an enlarged, side elevational view of a portion of the flexible, reclosable package of FIG. 2.
Figure 2:
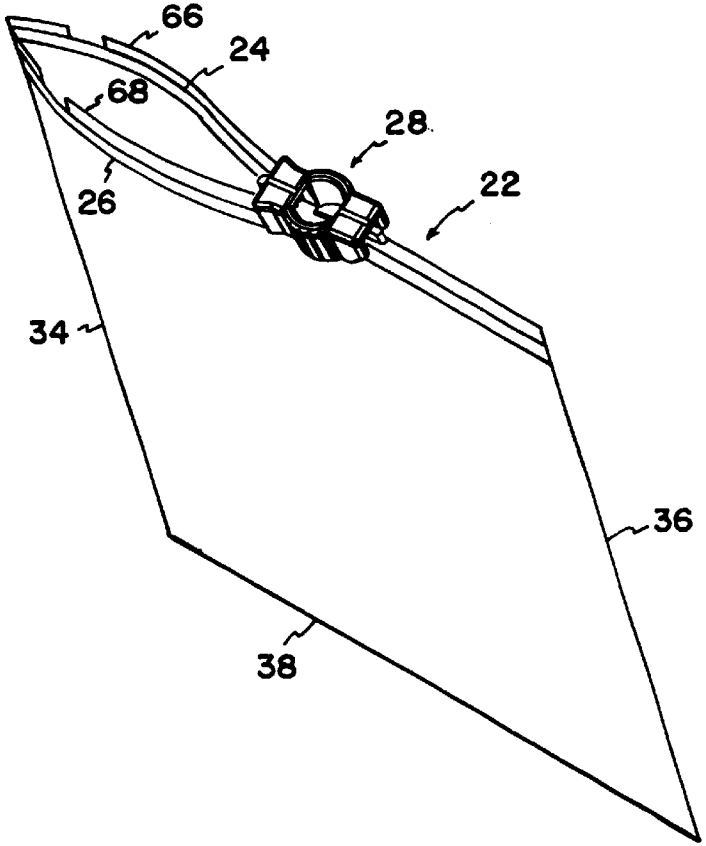
FIG. 2 is another perspective view of the embodiment of a flexible, reclosable package depicted in FIG. 1.

The arrangement shown in FIGS. 1–4 can present problems in certain instances. For example, when the first and second panel sections 30, 32 are pulled apart from each other in the direction of arrows 102, 104 (FIG. 1) the slider device 28 can be ejected or forced off of the package 20 due to the forces created by the pulled apart panel sections 30, 32. Although no particular theory with respect to this is asserted herein, it is believed that because the seal region 90 is positioned ahead of or to the right end of the slider device 28 (as seen in FIGS. 3 and 4) as the mouth 40 is opened, there are forces tending to push the slider device 28 off of the package 20 or toward the seal region 90. The forces cause the slider device 28 to slide up to the point at which there is a seal (seal region 90) that holds the panel sections 30, 32 together.

FIGS. 5–9 and 14 illustrate embodiments of the present invention that help to correct this problem. In other words, the embodiments of FIGS. 5–9 and 14 help to prevent the slider device 28 from being forced or ejected from the package 20 when the first and second panel section 30, 32 are pulled apart.

Figure 5:
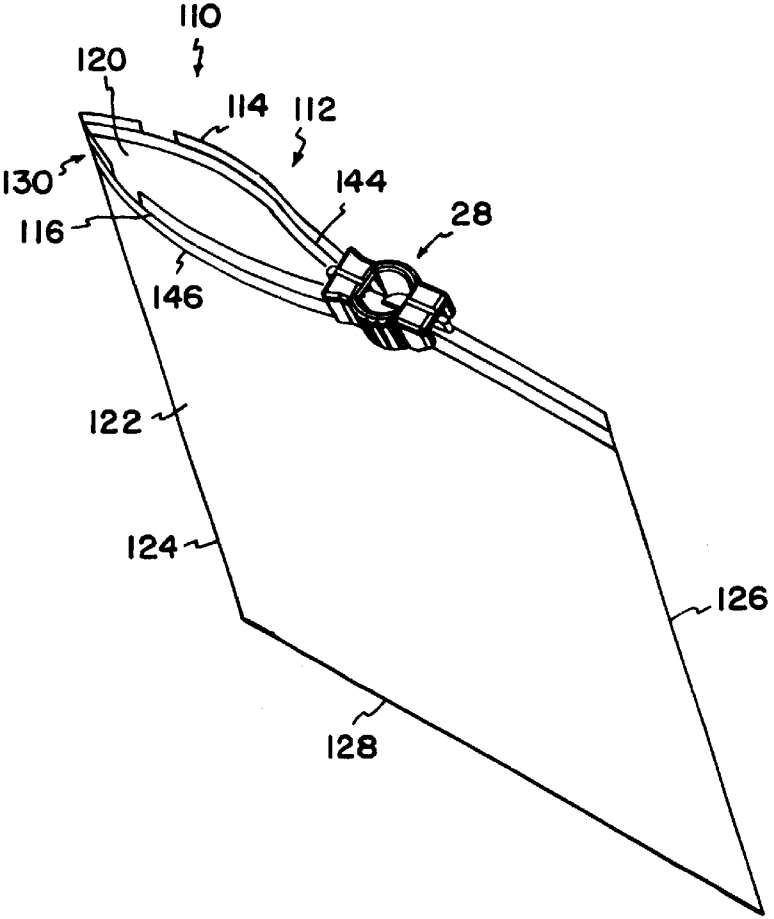
FIG. 5 is a perspective view of a first embodiment of a flexible, reclosable package constructed according to principles of the present invention.

FIG. 5 illustrates a perspective view of a package 110 constructed according to principles of the present invention. The package 110 includes a zipper 112, a first closure profile 114, a second closure profile 116, a first panel section 120, and a second panel section 122 analogous to the corresponding structure depicted and described in conjunction with FIG. 1. The first and second panel sections 120, 122 are joined to each other along side edges 124 and 126 to form a surrounding wall having an interior. A bottom edge 128 extends between side edges 124, 126. A mouth 130 allows access to the interior of the package 110. The slider device 28 is shown on the package 110 to open and close the zipper 112.

Figure 6:
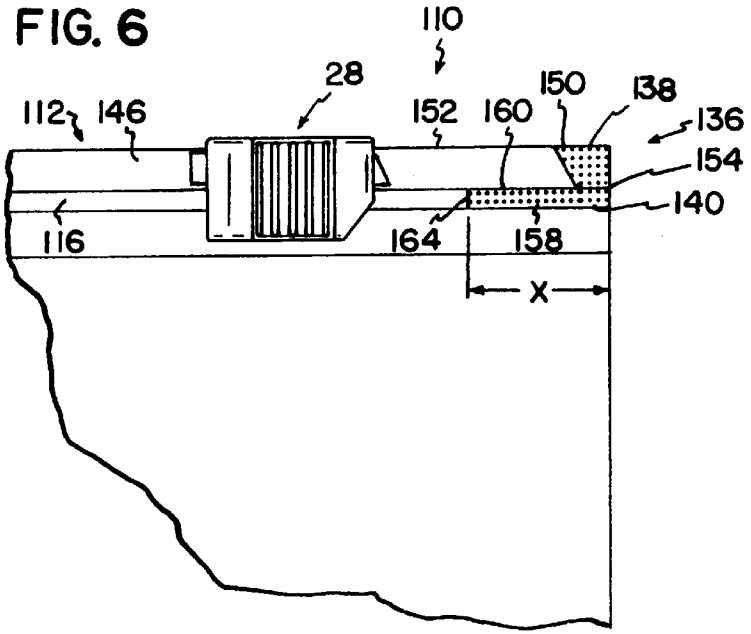
FIG. 6 is an enlarged, side elevational view of a portion of the flexible, reclosable package of FIG. 5.

FIG. 6 illustrates an enlarged side elevational view of a portion of the package 110 and slider 28. A seal region is shown at 136. The seal region 136 includes a first seal region 138 and a second seal region 140. The first seal region 138 acts to permanently secure together the upper flanges 144, 146 of the first and second closure profiles 114, 116. By "permanently secure", it is meant that the upper flanges 144, 146 are heat sealed or ultrasonically crushed together in a non-temporary manner such that they cannot be selectively removed and re-secured together. The first seal region 138 has a generally trapezoidal configuration extending from a wider portion 150 at the end 152 of the upper flanges 144, 146 to a narrower portion 154. Note that the first seal region 138 projects toward the remaining portions of the package 110 from the side edge 126 some distance. In particular, the wider portion 150 defines a length of the first seal region 138 from the side edge 126.

Figure 7:
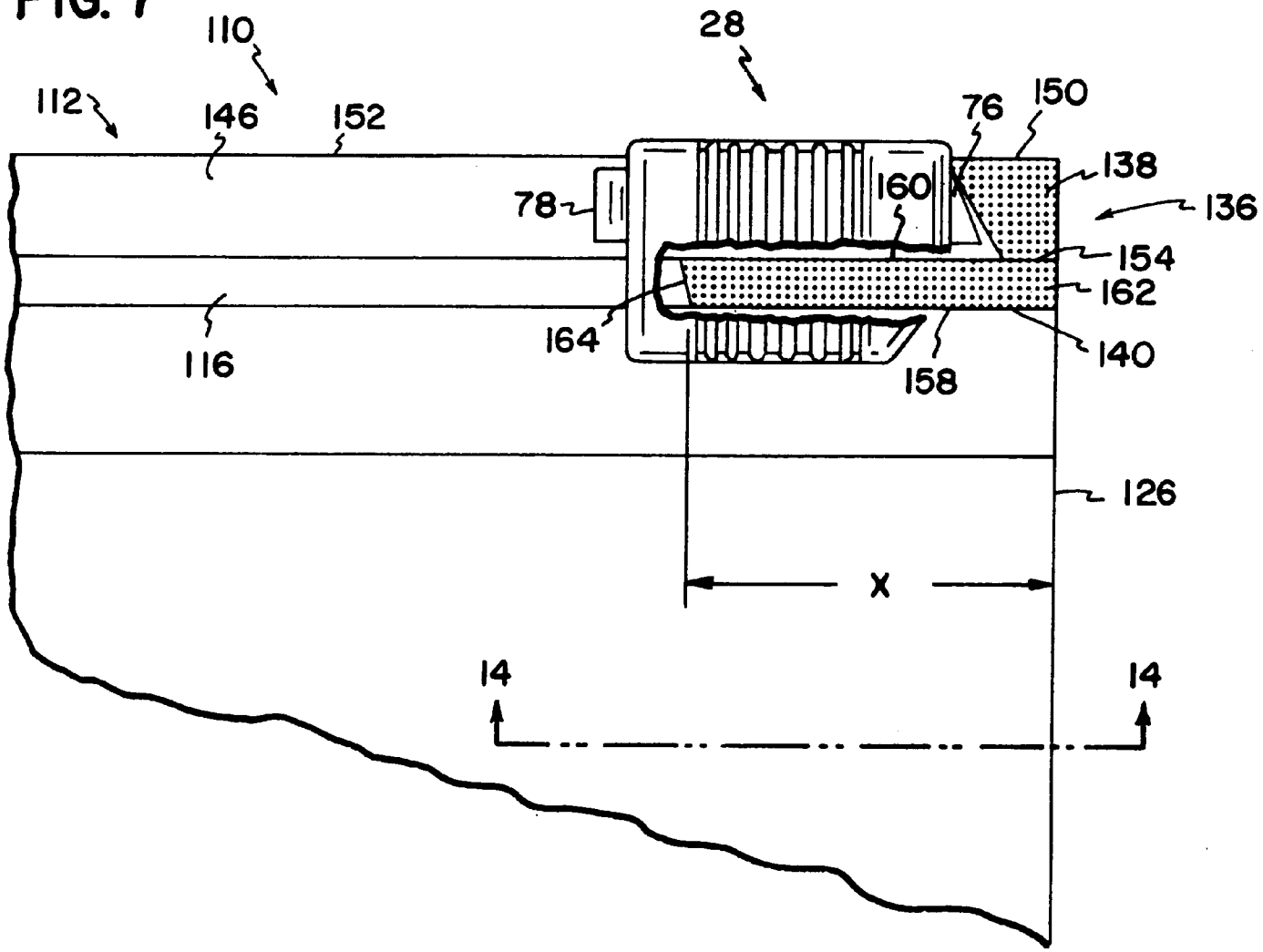
FIG. 7 is an enlarged, side elevational view of the flexible, reclosable package depicted in FIGS. 5 and 6 and showing the slider device adjacent to the side edge.

Attention is still directed to FIGS. 6 and 7. The second seal region 140 acts to permanently secure or seal together the closure members of the first and second closure profiles 114, 116. As can be seen in FIGS. 6 and 7, the second seal region 140 has an end edge 164 that extends a distance X from the side edge 126 toward remaining portions of the package 110. This distance X is sufficient such that lateral pulling forces such as those shown in FIG. 1 at arrows 102 and 104 cannot act to push or eject the slider device 28 from the package 110. In preferred embodiments, the distance X is long enough to extend at least 25% of the overall length of the slider device 28. In some embodiments, it is foreseeable that the distance X could extend 100% or more of the length of the slider device 28. In the particular embodiment illustrated, the distance X extends between 50–90% of the length of the slider device 28. In preferred embodiments, this corresponds to a distance X of at least 0.5 inches (1.3 cm), no greater than 2 inches (5.1 cm), typically about 0.75–1.25 inches (1.9–3.2 cm), and in one example about 1 inch (2.5 cm).

Still in reference to FIG. 7, note that the second seal region 140 generally includes a straight segment 158, an opposite and parallel straight segment 160, and a segment 162 that is flush with the edge 126 and intersects the segments 158, 160. Opposite of the segment 162 is end edge or segment 164. The end edge 164 also intersects straight segments 158, 160. In the embodiment illustrated, end edge 164 comprises a segment that extends at an acute angle relative to the side edge 126. It can be seen that the second seal region 140 comprises a continuous, uninterrupted extension from the side edge 126 to the end edge 164.

Note that the distance X that the second seal region 140 extends from the side edge 126 is greater than the distance that the outer most portion of the first seal region 138 extends from the side edge 126. In preferred embodiments, the distance X will be at least twice and in some instances can be up to six times the distance that the first seal region 138 extends from the edge 126 of the package 110. In the particular embodiment shown, the distance X that the second seal region 140 extends from the side edge 126 is typically between 3–5 times, and in one example about 4 times the distance that the first seal region 138 extends from the side edge 126 of the package 110.

Figure 14:
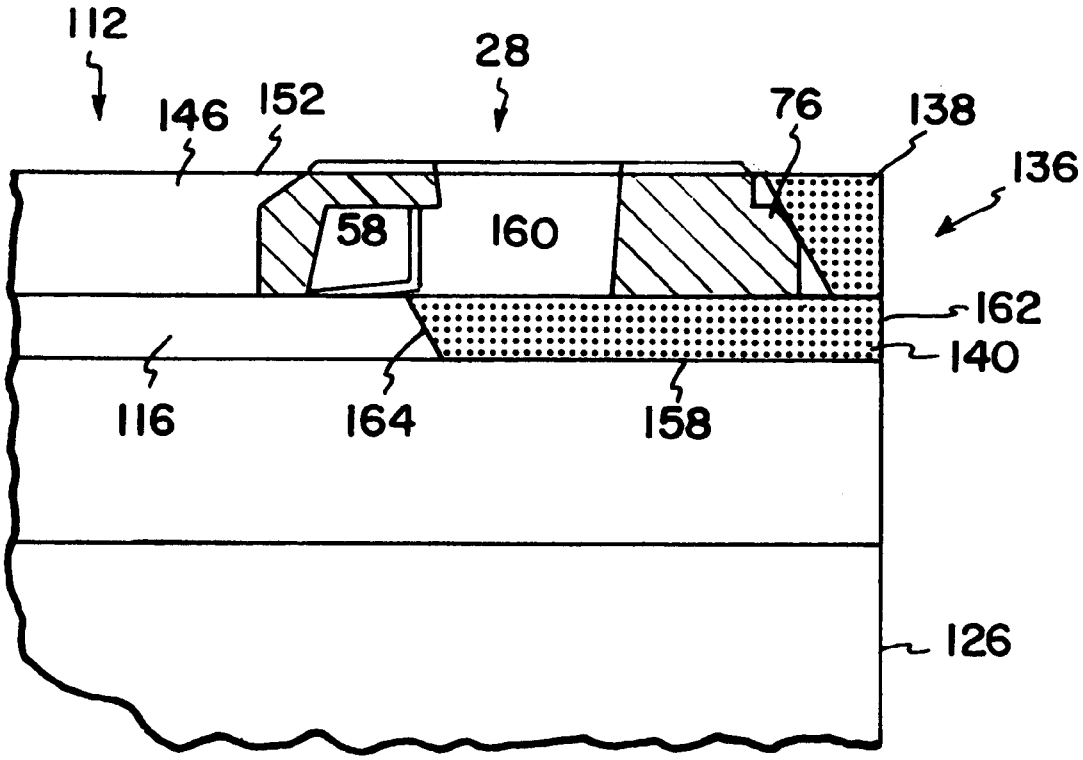
FIG. 14 is a cross-sectional view of the slider device and flexible package of FIG. 7 taken along the line 14—14.

FIG. 14 illustrates a schematic cross-section of the slider device 28 engaging the seal region 136. The wedge 58 of the plow 56 can be seen relative to the second seal region 140. In the particular embodiment illustrated, the wedge 58 just overlaps a portion of the straight segment 160 of the second seal region 140. In other embodiments, the wedge 58 will not overlap the second seal region 140. It can also be seen in FIG. 14 how the finger 76 is engaging and abutting the first seal region 138.

Figure 9:
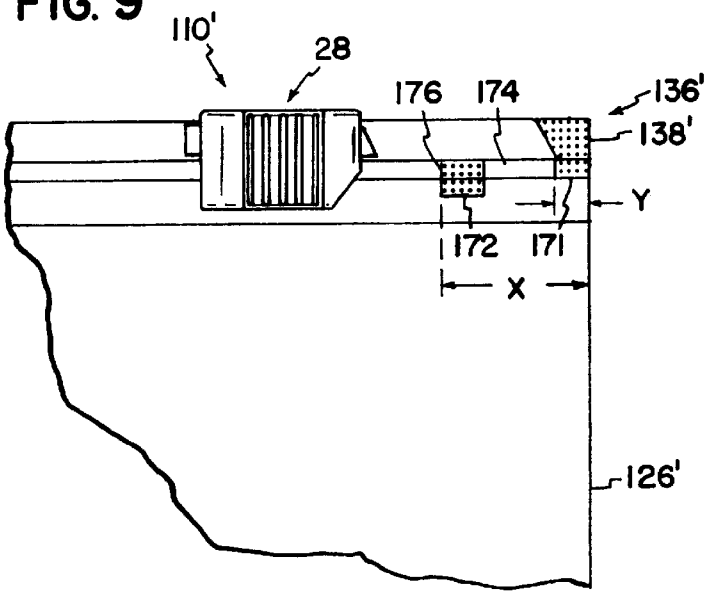
FIG. 9 is an enlarged, side elevational view of a portion of the flexible, reclosable package of FIG. 8.
Figure 8:
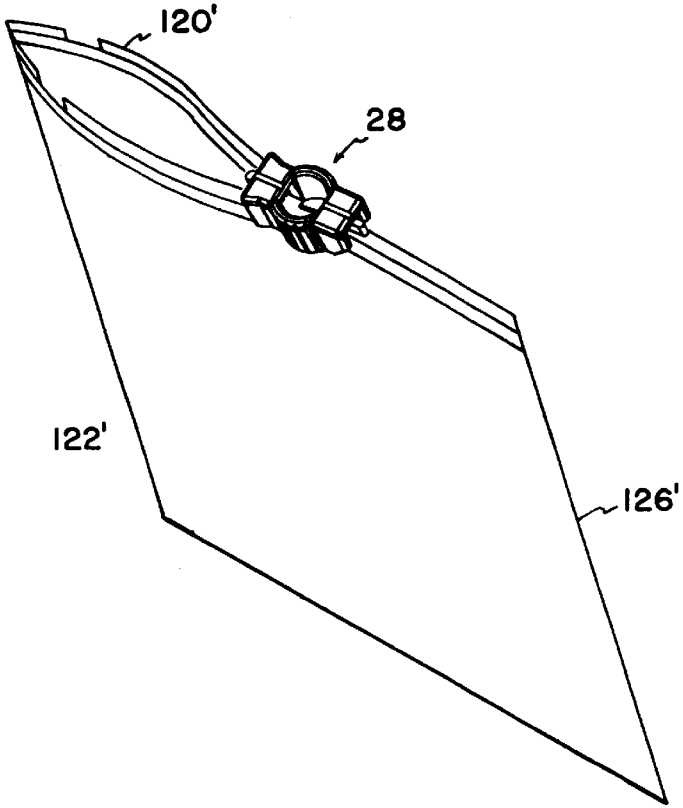
FIG. 8 is a perspective view of a second embodiment of a flexible, reclosable package constructed according to principles of the present invention.
Figure 10:
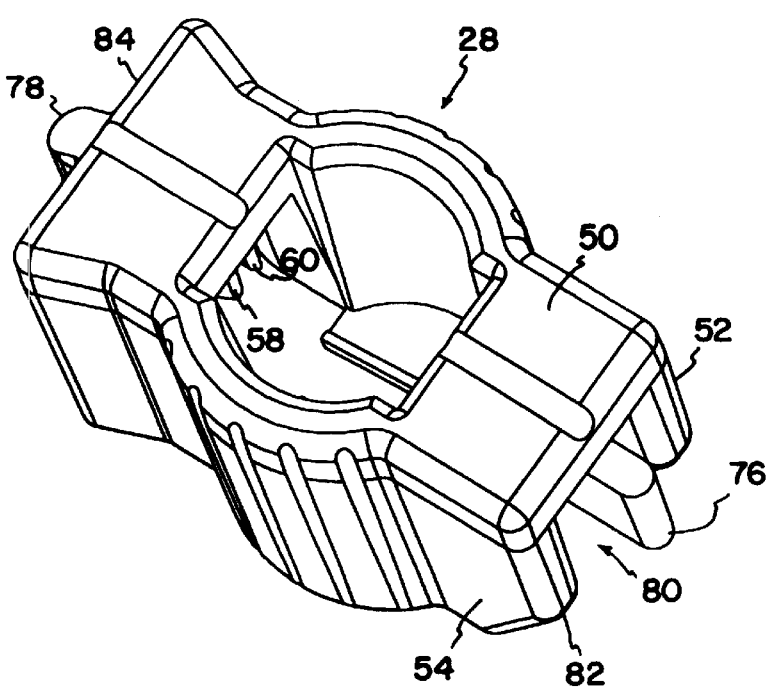
FIG. 10 is a perspective view of a slider device useable in the flexible, reclosable package depicted in FIGS. 1–9 and 14.
Figure 11:
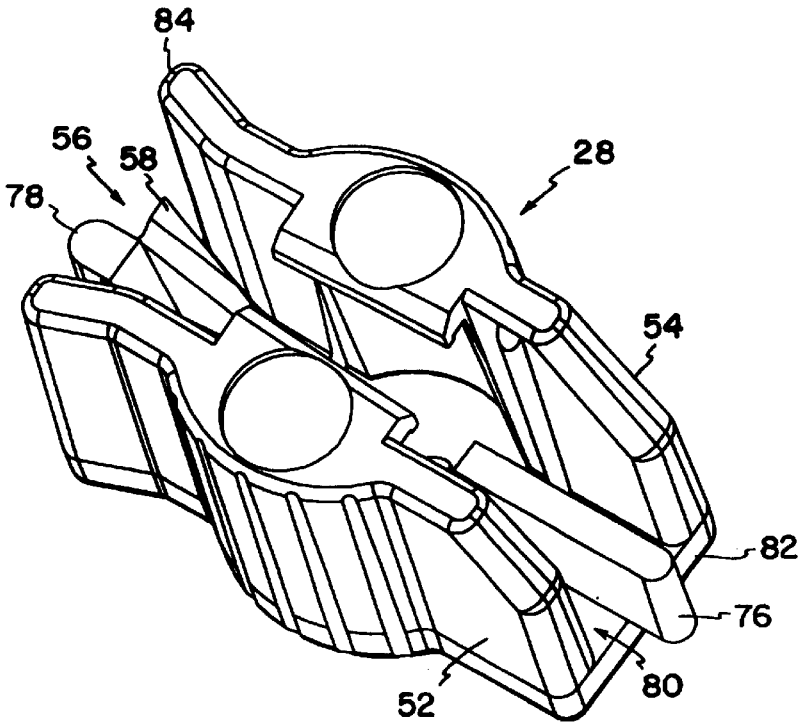
FIG. 11 is another perspective view of the slider device depicted in FIG. 10.

FIGS. 8 and 9 illustrate another embodiment of the present invention. The package 110' has structure analogous to that described with respect to FIGS. 5 and 6. The seal region 136' includes a first seal region 138', that is analogous to the first seal region 138 of FIGS. 5–7. The first seal region 138' extends a distance Y from the side edge 126'. The seal region 136' also includes a second seal region 170. In this embodiment, the second seal region 170 includes more than one joint or seal. In particular, the second seal region 170 includes a first seal section 171 and a second seal section 172. The first seal section 171 is even with and flush against the side edge 126'. The first seal section 171 is also adjacent to and below the first seal region 138'. The second seal section 172 is spaced from the first seal section 171 such that there is a gap or space between the second seal section 172 and first seal section 171. In the particular embodiment illustrated, the second seal section 172 is generally rectangular having four straight sides. The side edge 176 of the second seal section 172 defines an end edge that is most remote from the side edge 126. This side edge 176 is spaced a distance X from the side edge 126. Again, this distance X should be a sufficiently spaced distance such that when the panel sections 120', 122' are pulled apart, the second seal section 172 will prevent forces from ejecting or forcing off the slider device 28 from the package 110'. As with the embodiment of FIGS. 5–7, the distance X can be from 2–6 times the distance Y, for example about 3–5 times the distance of Y. Further, the distance X can be from 25%–100% of the overall length of the slider device 28, for example 50%–90%. In terms of absolute distance, preferred embodiments will have the distance of at least 0.5 inches (1.3 cm), for example 0.75–1.25 inches (1.9–3.2 cm), for example about 1 inch (2.5 cm).

The above specification and examples are believed to provide a complete description of the manufacture and use of particular embodiments of the invention. Many embodiments of the invention can be made without departing from the spirit and scope of the invention.

I claim:

1. A flexible package comprising:

(a) a package surrounding wall having a side edge and a mouth therebetween; said mouth providing access to a package interior;
  (i) said surrounding wall including a second side edge and a bottom edge;

(b) a reclosable zipper along said mouth for selective opening and closing of said mouth; said zipper including first and second closure profiles;
  (i) said first closure profile having a first closure member and a first flange;
  (ii) said second closure profile having a second closure member and a second flange;
  (iii) said first and second closure members constructed and arranged to selectively interlock;

(c) a slider device constructed and arranged to selectively open and close said zipper; said slider device having a length;

(d) a first seal region and a second seal region;
  (i) said first seal region permanently securing together said first and second flanges of said first and second closure profiles; said first seal region having a first length extending from said side edge;
  (ii) said second seal region permanently securing together said first and second closure members of said first and second closure profiles; said second seal region having an end edge extending a second length from said side edge;
  (iii) said second length being greater than said first length; said second length being at least 25% of the length of said slider device; and
  (iv) said second seal region being adjacent to said first seal region and oriented between said first seal region and said bottom edge.

2. A flexible package according to claim 1 wherein:

(a) said second seal region comprises a continuous, uninterrupted extension from said side edge to said end edge.

3. A flexible package according to claim 1 wherein:

(a) said second seal region comprises first and second seal sections separated by a gap;
  (i) said first seal section being adjacent to said side edge; and
  (ii) said second seal section defining said end edge.

4. A flexible package according to claim 1 wherein:

(a) said second length is between twice and five times of said first length.

5. A flexible package according to claim 1 wherein:

(a) said second length is about four times of said first length.

6. A flexible package according to claim 1 wherein:

(a) said second length is between 0.5–2.0 inches.

7. A flexible package according to claim 1 wherein:

(a) said second length is between 0.75–1.25 inches.

8. A reclosable zipper arrangement comprising:

(a) first and second closure profiles; each of said first and second closure profiles having first and second opposite ends;
  (i) said first closure profile having a first closure member and a first flange;
  (ii) said second closure profile having a second closure member and a second flange;

(iii) said first and second closure members constructed and arranged to selectively interlock;

(b) a slider device constructed and arranged to selectively open and close said first and second closure profiles; said slider device having a length;

(c) a first seal region and a second seal region;

(i) said first seal region permanently securing together said first and second flanges of said first and second closure profiles; said first seal region having a first length extending from first end;

(ii) said second seal region permanently securing together said first and second closure members of said first and second closure profiles; said second seal region having an end edge extending a second length from first end;

(A) said second seal region comprising first and second seal sections separated by a gap;

(B) said first seal section being adjacent to said side edge;

(C) said second seal section defining said end edge; and (iii) said second length being greater than said first length; said second length being at least 25% of the length of said slider device.

9. A reclosable zipper arrangement according to claim 8 wherein:

(a) said second length is between twice and five times of said first length.

10. A reclosable zipper arrangement according to claim 8 wherein:

(a) said second length is about four times of said first length.

11. A reclosable zipper arrangement according to claim 8 wherein:

(a) said second length is between 0.5–2.0 inches.

12. A reclosable zipper arrangement according to claim 8 wherein:

(a) said second length is between 0.75–1.25 inches.

13. A method for constructing a flexible package, comprising the steps of:

(a) forming a surrounding wall having a side edge and a mouth therebetween; the mouth providing access to a package interior;

(i) the surrounding wall including a second side edge and a bottom edge;

(b) forming a reclosable zipper along the mouth for selective opening and closing of the mouth; the zipper including first and second closure profiles;

(i) the first closure profile having a first closure member and a first flange;

(ii) the second closure profile having a second closure member and a second flange;

(iii) the first and second closure members constructed and arranged to selectively interlock;

(c) forming first and second seal regions adjacent to first and second side edges, respectively;

(i) the first seal region permanently securing together the first and second flanges of the first and second closure profiles; the first seal region having a first length extending from the side edge;

(ii) the second seal region permanently securing together the first and second closure members of the first and second closure profiles; the second seal region having an end edge extending a second length from the side edge;

(iii) the second length being greater than the first length; the second length being at least 25% of the length of the slider device;

(iv) the second seal region being adjacent to the first seal region and oriented between the first seal region and the bottom edge;

(c) non-removably joining first and second flanges adjacent to the first seal region;

(d) non-removably joining first and second flanges adjacent to the second seal region; and, (e) orienting a slider device on the zipper; the slider being operably slidable between an open and closed position; the slider having a length; wherein the slider is located adjacent to the first seal region in the open position; and the slider is located adjacent to said second seal region in the closed position.

14. A method for constructing a flexible package according to claim 13 wherein:

(a) said step of forming the first and second seal regions includes forming the second seal region as a continuous, uninterrupted extension from the side edge to the end edge.

15. A method for constructing a flexible package according to claim 13 wherein:

(a) said step of forming the first and second seal regions includes forming the second seal region as first and second seal sections separated by a gap;

(i) the first seal section being adjacent to the side edge; and (ii) the second seal section defines the end edge.

16. A method for constructing a flexible package according to claim 13 wherein:

(a) said step of forming the first and second seal regions includes forming the second length between twice and five times the first length.

17. A method for constructing a flexible package according to claim 13 wherein:

(a) said step of forming the first and second seal regions includes forming the second length about four times the first length.

18. A method for constructing a flexible package according to claim 13 wherein:

(a) said step of forming the first and second seal regions includes forming the second length between 0.5–2.0 inches.

19. A method for constructing a flexible package according to claim 13 wherein:

(a) said step of forming the first and second seal regions includes forming the second length between 0.75–1.25 inches.

20. A flexible package comprising:

(a) a package surrounding wall having a side edge and a mouth therebetween; said mouth providing access to a package interior;

(b) a reclosable zipper along said mouth for selective opening and closing of said mouth; said zipper including first and second closure profiles;

(i) said first closure profile having a first closure member and a first flange;

(ii) said second closure profile having a second closure member and a second flange;

(iii) said first and second closure members constructed and arranged to selectively interlock;

(c) a slider device constructed and arranged to selectively open and close said zipper; said slider device having a length;

(d) a first seal region and a second seal region;

(i) said first seal region permanently securing together said first and second flanges of said first and second closure profiles; said first seal region having a first length extending from said side edge;

(ii) said second seal region permanently securing together said first and second closure members of said first and second closure profiles; said second seal region having an end edge extending a second length from said side edge;

(A) said second seal region comprising first and second seal sections separated by a gap;

(B) said first seal section being adjacent to said side edge;

(C) said second seal section defining said end edge; and (iii) said second length being greater than said first length; said second length being at least 25% of the length of said slider device.

21. A flexible package according to claim 20 wherein:

(a) said second length is between twice and five times of said first length.

* * * * *